US010283041B2

(12) United States Patent
Matsumoto

(10) Patent No.: US 10,283,041 B2
(45) Date of Patent: May 7, 2019

(54) DISPLAY DEVICE

(71) Applicant: NICHIA CORPORATION, Anan-shi (JP)

(72) Inventor: Makoto Matsumoto, Tokushima (JP)

(73) Assignee: NICHIA CORPORATION, Anan-shi (JP)

( * ) Notice: Subject to any disclaimer, the term of this patent is extended or adjusted under 35 U.S.C. 154(b) by 0 days.

(21) Appl. No.: 15/874,881

(22) Filed: Jan. 19, 2018

(65) Prior Publication Data

US 2018/0204507 A1 Jul. 19, 2018

(30) Foreign Application Priority Data

Jan. 19, 2017 (JP) ..... 2017-007632

(51) Int. Cl.
*G09G 3/3216* (2016.01)
*G09G 3/32* (2016.01)
*G09G 3/20* (2006.01)

(52) U.S. Cl.
CPC ..... *G09G 3/32* (2013.01); *G09G 3/2022* (2013.01); *G09G 3/3216* (2013.01); *G09G 2300/0847* (2013.01); *G09G 2320/0233* (2013.01); *G09G 2320/0266* (2013.01); *G09G 2320/0646* (2013.01)

(58) Field of Classification Search
None
See application file for complete search history.

(56) References Cited

U.S. PATENT DOCUMENTS 5,986,640 A * 11/1999 Baldwin ..... G09G 3/2033 345/596
6,088,012 A * 7/2000 Shigeta ..... G09G 3/2033 345/596
8,228,349 B2 * 7/2012 Ng ..... G09G 3/2029 345/214
2004/0239696 A1 12/2004 Okabe et al.
2006/0044231 A1 * 3/2006 Seki ..... G09G 3/2055 345/76
2007/0008252 A1 * 1/2007 Seki ..... G09G 3/2025 345/76
2007/0085785 A1 * 4/2007 Ozaki ..... G09G 3/2025 345/77

(Continued)

FOREIGN PATENT DOCUMENTS

JP 2005-010741 1/2005

*Primary Examiner* — Chad M Dicke
(74) *Attorney, Agent, or Firm* — Mori & Ward, LLP

(57) ABSTRACT

A display apparatus time-divisionally expresses gradation values allocated to the sub-frames so that the gradation value of the single frame is expressed by a total of the gradation values of the sub-frames. Each of the plurality of sub-frames includes a plurality of weighted elements with different gradation values to express the gradation values by powers of two. A lighting controller performs control such that the weighted elements in at least one of the plurality of sub-frames in one frame are aligned in an order different from an order of the weighted elements in at least one of the plurality of sub-frames in another frame and, of the plurality of weighted elements in at least one of the plurality of sub-frames in the single frame, the weighted element at the end of the timeline turns OFF a corresponding one of the light emitting elements.

16 Claims, 8 Drawing Sheets

(56) References Cited

U.S. PATENT DOCUMENTS

| | | | | |
|---|---|---|---|---|
| 2016/0055788 | A1* | 2/2016 | Gandhi | G09G 3/2029<br>345/693 |
| 2016/0365033 | A1* | 12/2016 | Song | G09G 3/3258 |

* cited by examiner

DISPLAY DEVICE

CROSS-REFERENCE TO RELATED APPLICATION

The present application claims priority under 35 U. S. C. § 119 to Japanese Patent Application No. 2017-007632, filed Jan. 19, 2017. The contents of this application are incorporated herein by reference in their entirety.

BACKGROUND

1. Technical Field

The present disclosure relates to a display device including a plurality of light emitting elements.

2. Description of Related Art

Nowadays, a display unit using light emitting diodes (LEDs) as light emitting elements and a display apparatus using the display unit are manufactured. For example, a large-screen display apparatus can be made by combining a plurality of display units. In a display unit including LEDs arranged in a dot matrix array of m rows and n columns, for example, anode terminals of LEDs located at each row are electrically connected to a single common line and cathode terminals of LEDs located at each column are electrically connected to a single drive line. The common lines of m-rows are successively turned ON with a predetermined cycle and the LEDs arranged on the turned ON common lines are individually driven by the drive lines.

In a known method, gradation control of such a display apparatus is operated through turning on and off a plurality of light emitting elements by weighting lighting periods to power of two such as 1:2:4:8 (for example, see Japanese Unexamined Patent Application Publication No. 2005-010741). Such a control method may be referred to as "weighting control."

However, in a conventional weighting control, positions to be lit are determined based on weighting arrangement, so that when the last weighted element in a timeline is turned on, significant pseudo lighting may be caused. Pseudo lighting may also be called erroneous lighting, false lighting, feeble lighting, or the like, and is typically referred to as unintended lighting caused by accumulated electric charges in a parasitic capacitance of a wiring.

The present disclosure has been made in view of such a problem associated with the conventional technique. The present disclosure advantageously provides a display device in which erroneous lighting of light emitting elements is reduced and display quality is improved.

SUMMARY

A display apparatus according to one aspect of the present disclosure includes: a plurality of common lines; a plurality of drive lines; a plurality of light emitting elements respectively connected to one common line of the plurality of common lines and to one drive line of the plurality of drive lines; a voltage scanner to time-divisionally apply a voltage on the plurality of common lines; a current driver to draw electric current at a predetermined timing from drive lines, of the plurality of drive lines, electrically connected to respective light emitting elements, of the plurality of light emitting elements, to turn ON the respective light emitting elements; and a lighting controller to vary lighting periods of the plurality of light emitting elements to express lighting amounts as different gradation values. A single frame is divided into a plurality of sub-frames and a gradation value to express in the single frame is divided into gradation values and allocated to the plurality of sub-frames, the gradation values allocated to the sub-frames are time-divisionally expressed so that the gradation value of the single frame is expressed by a total of the gradation values of the sub-frames. Each of the plurality of sub-frames includes a plurality of weighted elements with different gradation values to express the gradation values by powers of two. The lighting controller performs control such that the weighted elements in at least one sub-frame of the plurality of sub-frames in one frame are aligned in an order different from an order of the weighted elements in at least one sub-frame of the plurality of sub-frames in another frame and, of the plurality of weighted elements in at least one sub-frame of the plurality of sub-frames in the single frame, the weighted element at the end of the timeline turns OFF a corresponding one light emitting element of the plurality of light emitting elements.

The display apparatus according to one aspect of the present disclosure controls an order of weighted elements with gradation values by powers of 2 such that a weighted element at an end of the timeline in a sub-frame is set to turn OFF its corresponding light emitting element, instead of a regular order such as ascending order or descending order. This allows for reducing pseudo lighting due to charging/discharging parasitic capacitance.

A display apparatus according to another aspect of the present disclosure includes: a plurality of common lines; a plurality of drive lines; a plurality of light emitting elements respectively connected to one common line of the plurality of common lines and to one drive line of the plurality of drive lines; a voltage scanner to time-divisionally apply a voltage on the plurality of common lines; a current driver to draw electric current at a predetermined timing from drive lines, of the plurality of drive lines, electrically connected to respective light emitting elements, of the plurality of light emitting elements, to turn ON the respective light emitting elements; and a lighting controller to vary lighting periods of the plurality of light emitting elements to express lighting amounts as different gradation values. A single frame is divided into a plurality of sub-frames and a gradation value to express in the single frame is divided into gradation values and allocated to the plurality of sub-frames, the gradation values allocated to the sub-frames are time-divisionally expressed so that the gradation value of the single frame is expressed by a total of the gradation values of the sub-frames. Each of the plurality of sub-frames includes a plurality of weighted elements with different gradation values to express the gradation values by powers of two. The lighting controller performs control such that the weighted elements in at least one sub-frame of the plurality of sub-frames in the single frame are aligned in an order different from an order of the weighted elements in at least another sub-frame of the plurality of sub-frames in the single frame and, of the plurality of weighted elements in the at least one sub-frame of the plurality of sub-frames in the single frame, the weighted element at the end of the timeline turns OFF a corresponding one light emitting element of the plurality of light emitting elements.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION

Figure 1:
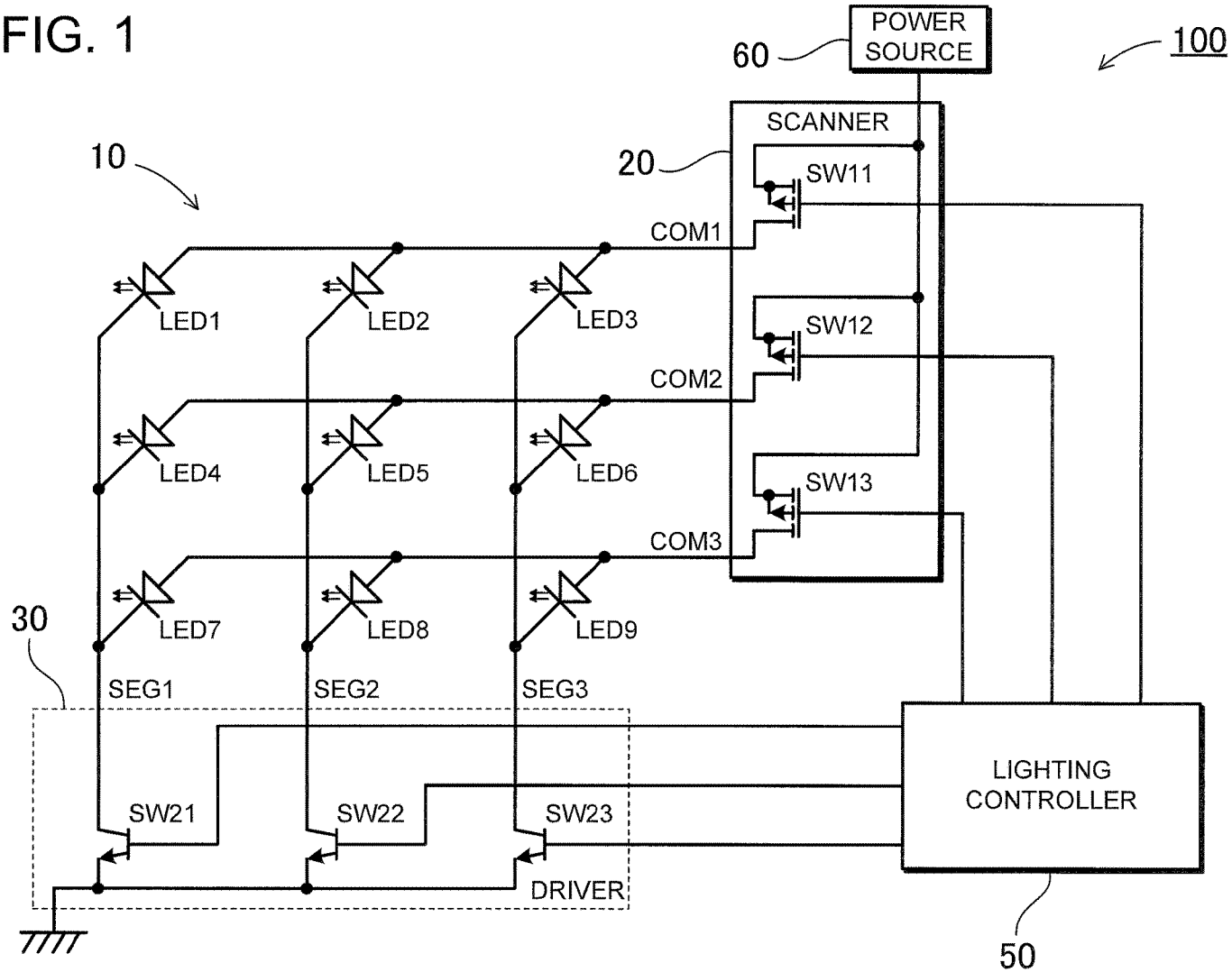
FIG. 1 is a circuit diagram of a display device according to a first embodiment.

The embodiments according to the present invention will be described below with reference to the drawings. The embodiments shown below are intended as illustrative to give a concrete form to technical ideas of the present invention, and the scope of the invention is not limited to those described below. Further, the members shown in claims attached hereto are not specifically limited to members in the embodiments. The sizes, materials, shapes and the relative configuration etc. of members described in embodiments are given as an example and not as a limitation to the scope of the invention unless specifically described otherwise. The sizes, the arrangement relationships of the members in each of drawings are occasionally shown exaggerated for ease of explanation. In the description below, the same designations or the same reference numerals denote the same or like members and duplicative descriptions will be appropriately omitted. In addition, a plurality of structural elements of the present invention may be configured as a single part which serves the purpose of a plurality of elements, on the other hand, a single structural element may be configured as a plurality of parts which serve the purpose of a single element. Description given in one example and one embodiment can also be applied in other examples and embodiments.

In the present specification, the term "parasitic capacitance" mainly refers to a parasitic capacitance in drive lines. Parasitic capacitance may exist between parts of electronic components, for example, caused by an electronic component having a capacitance connected to a drive line.

FIRST EMBODIMENT

FIG. 1 is a circuit diagram of a display apparatus according to a first embodiment. As shown in FIG. 1, a display apparatus 100 includes a display 10, a voltage scanner 20, a current driver 30, and a lighting controller 50. The display 10 includes a plurality of common lines COM1 to COM3, a plurality of drive lines SEG1 to SEG3, and a plurality of light emitting elements LED1 to LED9.

The plurality of light emitting elements are electrically connected to a plurality of common lines and a plurality of drive lines. In the present embodiment, light emitting diodes (LEDs) are used as the light emitting elements. The plurality of light emitting elements are arranged in rows and columns and respectively electrically connected to one of the plurality of common lines and one of the plurality of drive lines to form the display 10.

The voltage scanner 20 time-divisionally applies voltage to the plurality of common lines and includes one or more source drivers. Further, an electric power source (power supply) 60 is electrically connected to the voltage scanner 20 to supply electric power to drive elements such as transistor that form the voltage scanner 20. In the example shown in FIG. 1, a common anode configuration in which anode-sides of the plurality of light emitting elements are electrically connected to the power source side if adapted.

The current driver 30 draws electric current at predetermined timings from the drive lines electrically connected to the light emitting elements to light, and includes one or more sink drivers.

Figure 2:
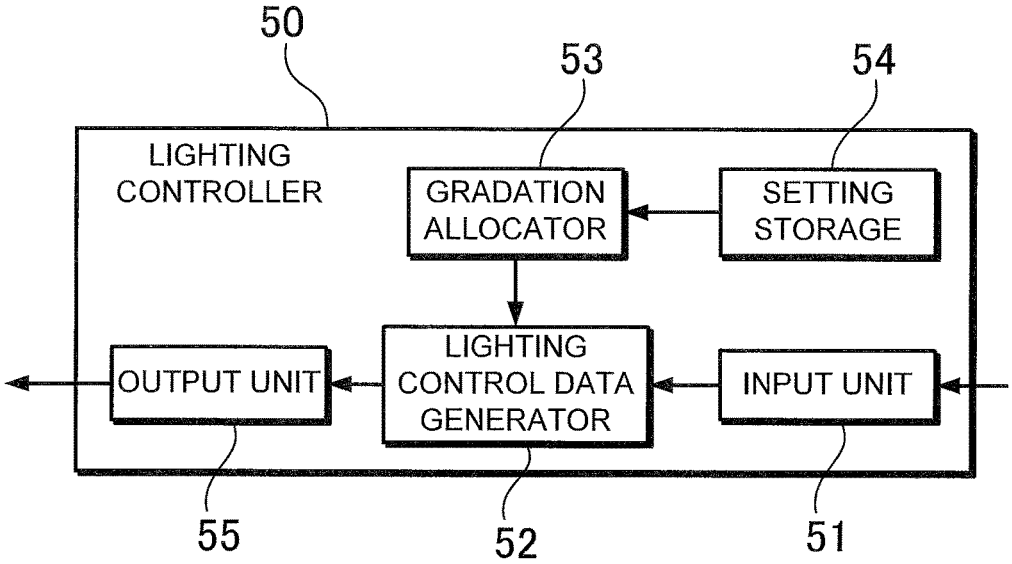
FIG. 2 is a functional block diagram showing an example of a lighting controller.
Figure 3:
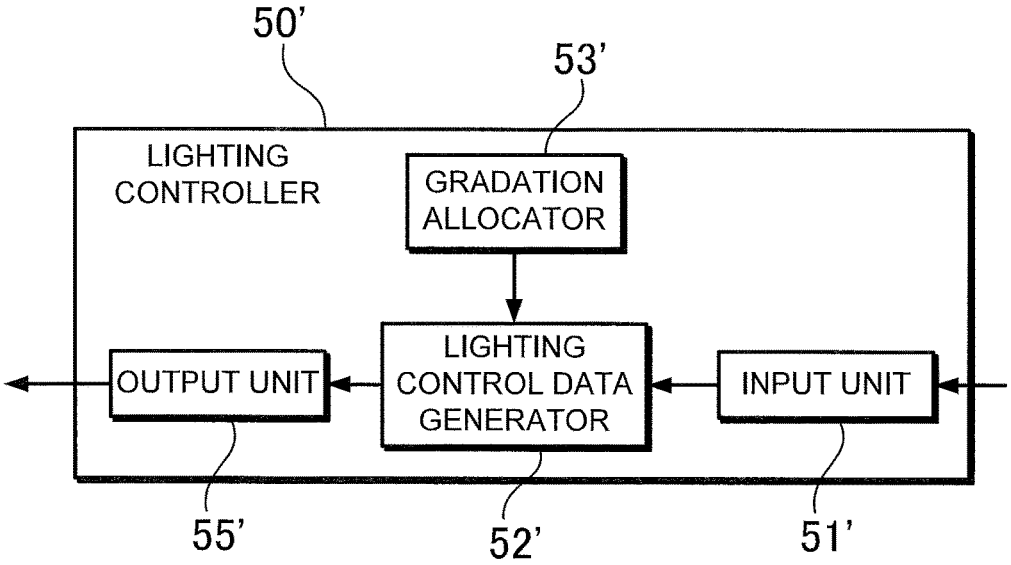
FIG. 3 is a functional block diagram showing another example of a lighting controller.

The lighting controller 50 controls those operations of the voltage scanner 20 and the current driver 30. An example of functional block diagram of the lighting controller 50 is illustrated in FIG. 2. The lighting controller 50 shown in FIG. 2 includes an input unit 51, a lighting control data generator 52, a gradation allocator 53, a setting storage 54, and an output unit 55. Such a lighting controller 50 can be realized by hardware such as predetermined gate arrays (such as FPGA and ASIC) or the like, and software, or combination of those. The configuration of those components is not necessarily the same as those illustrated in FIG. 2 and FIG. 3 that will be described below, and those having functions substantially the same or a component having function of plurality of components shown in FIG. 2 and/or FIG. 3 will also be included in the present invention.

Allocation of gradation to the sub-frames and an order in a sequence in weighted elements, which will be described below, are preferably predetermined for each gradation value corresponding to the number of sub-frames or the like. For example, the corresponding relationship between indicated gradation values and respective corresponding gradation values allocated to sub-frames 1 to 4 is held as data to create a lookup table or the like, and stored in the setting storage unit 54 shown in the functional block diagram of FIG. 2 in advance and is referred to by the lighting control unit 50. Thus, when a gradation value is specified, allocation of gradation values to the sub-frames is uniquely executed, and by the lighting controller 50, lighting control is performed according to the gradations allocated to the sub-frames. Alternatively, for example, the gradation values allocated to each of the sub-frames corresponding to the specified gradation values may not be fixed but may be set variably. For example, the lighting controller 50' shown in FIG. 3 controls the gradation values allocated to the sub-frames based on the specified gradation value. The lighting controller 50' determines the gradation values to allocate to each of the sub-frames based on the number of the sub-frames, the gradation value to be displayed, or the like, corresponding to the specified gradation value. The lighting controller 50' shown in FIG. 3 includes an input unit 51', a lighting control data generator 52', a gradation allocator 53', and an output unit 55'. Those components exert functions basically similar to those exerted by the components shown in FIG. 3, so that detailed description will be appropriately omitted.

The input unit 51 receives data to be displayed from an external display source, for example. The lighting control data generator 52 generates lighting control data according to the display data that is received, to drive the voltage scanner 20 and the current driver 30. The gradation allocator 53 allocates gradations to the sub-frames, as described below, to express gradations. The lighting control data generator 52 produces lighting control data by allocating gradations determined by the gradation allocator 53 to the sub-frames. The setting storage 54 stores setting data such as number of gradations to allocate to the sub-frames by the gradation allocator 53. The setting storage 54 may use a storage medium and a non-volatile memory. The output circuit 55 operates the voltage scanner 20 and the current driver 30 to activate corresponding light emitting elements according to the lighting control data generated by the lighting control data generator 52. One image expressed on the display 10 is expressed by one cycle a combination of a plurality of single frames each obtained by a single scan the voltage scanner 20 scanned the common lines.

In order to express a multi-gradation color image, a single frame is divided into a plurality of sub-frames, gradation to be expressed in a single frame is divided and allocated through the sub-frames so that gradation allocated to each of the sub-frames is expressed in a time-sharing manner in operation. The allocation is provided by the gradation allocator 53. Thus, the gradation of a single frame is expressed with entire gradations of the sub-frames that form a single frame.

Each of the plurality of sub-frames is divided into a plurality of weighted elements each exhibiting different gradation based on powers of 2. Further, the weighted element at the end of the timeline in each single sub-frame is set to be turned OFF. When the number of sub-frames in a single frame is X (X is an integer greater than 1) and the greatest gradation value that can be exhibited in each of the sub-frames is $2^Y-1$ (Y is an integer greater than 1), the lighting controller 50 adjusts the sequence of the weighting elements so that, in a single sub-frame, a weighting element having gradation $2^{Y-2}$ at the end of the timeline turns OFF its corresponding light emitting element. This allows for extending a period in which the light emitting element is turned OFF, so that the pseudo lighting reducing effect is expected to be improved.

In arrangement of the plurality of sub-frames, for reducing the pseudo lighting, the weighted element at the end in the timeline of each of the sub-frames is allocated to the period of turning corresponding light emitting element OFF. If the duration of the OFF period is short, it is difficult to exert the pseudo lighting reducing effect. In order to effectively exert such a pseudo lighting reducing effect, a single sub-frame necessarily includes an OFF period of a certain length. Accordingly, it is preferable to adjust the sequence of the weighting elements so that, in a single sub-frame, a plurality of weighting elements at the end of the timeline turn OFF their corresponding light emitting elements. Thus, the number of the weighting elements that turns OFF their corresponding light emitting elements at the end of the timeline of each of the sub-frames is increased, so that the pseudo lighting reducing effect is expected to be improved. For example, in at least half among the plurality of sub-frames of a single frame, the light emitting elements corresponding to the weighting elements at the end of the timeline of each of the sub-frames is turned OFF.

Further, in at least one of the sub-frames of a single frame, weighted elements that turn ON their corresponding light emitting elements can be aligned in ascending order.

In the display device 100 according to the first embodiment, the order of the weighted elements in each of the sub-frames is adjusted so as to reduce the number of the light emitting element turned on at the end of the timeline in weighted alignment. That is, the order of the weighting elements in each of the sub-frames is adjusted so that, in a single frame, the end-weighted element in a timeline in a single sub-frame is OFF in at least one sub-frame in a single frame. Thus, reducing the number of lighting at the ends in timelines of a single sub-frame allows to provide a charging time for a parasitic capacitance between the drive line and ground (GND), through the light emitting element that is subjected to lighting. This can reduce the charging amount for the parasitic capacitance between the drive line and the GND, through the light emitting elements that are not subjected to lighting.

EXAMPLE OF OPERATION

Next, operation of a display apparatus 100 shown in FIG. 1 will be described below. In the example shown in FIG. 1, the display apparatus 100 includes a plurality of light emitting elements LED1 to LED9, three common lines COM1 to COM3 each electrically connected to first ends of the plurality of light emitting elements LED1 to LED3, a power source 60 to supply voltage to the plurality of light emitting elements LED1 to LED9, a plurality of drive lines SEG1 to SEG3 electrically connected to second ends of the plurality of light emitting elements LED1 to LED9, and a lighting controller 50 to control lighting of the plurality of light emitting elements LED1 to LED9. In the display device 100, when a gradation lighting control is performed, an electric current is drawn in a time divisional manner from the drive line electrically connected to the light emitting elements that are subjected to lighting.

Light Emitting Elements LED1 to LED9

As the plurality of light emitting elements, for example the plurality of light emitting elements LED1 to LED9 shown in FIG. 1 can be employed.

Common Lines COM1 to COM3

The common lines COM1 to COM3 are electrically connected to one ends of the plurality of light emitting elements LED1 to LED9. The plurality of light emitting elements LED1 to LED9 are connected to the common lines COM1 to COM3 in a common anode configuration as shown in FIG. 1. For the common lines COM1 to COM3, a copper foil or the like can be used (e.g., part of the interconnection of the printed circuit board). In the printed circuit board or the like, the common lines COM1 to COM3 can be formed into various shapes such as a linear shape or planar shape (a rectangular shape, a circular shape, or the like). The expression "line" is not intended to limit the actual shape of the common lines COM1 to COM3 formed on the printed circuit board or the like to a linear shape. Instead, the expression is used just because the common lines COM1 to COM3 can be represented by lines when they are schematically shown in a circuit diagram. Each of the common lines COM1 to COM3 may be split (branched) in midway. Note that, although three common lines are employed in the first embodiment, at least one common line will be sufficient.

Power Source 60

The power source 60 applies voltage to the plurality of light emitting elements LED1 to LED9. The power source 60 applies voltages in a time-sharing manner to each common line (dynamic control). For the power source 60, for example, a DC constant voltage source of a series system or a switching system can be employed.

Source Drivers SW11 to SW13

The source drivers SW11 to SW13 of the voltage scanner 20 are switches for connecting the common lines COM1 to COM 3 and are time-divisionally turned ON or OFF by the lighting controller 50. For the source drivers SW11 to SW13, a P-channel field effect transistor (FET) or a PNP transistor can be used.

Drive Lines SEG1 to SEG3

The plurality of drive lines SEG1 to SEG3 are connected to other ends of the plurality of light emitting elements LED1 to LED9. For the drive lines SEG1 to SEG3, a copper foil or the like (e.g., part of the interconnection of the printed circuit board) may be employed.

Sink Drivers SW21 to SW23

Sink drivers SW21 to SW23 of the current driver 30 are connected to a plurality of drive lines SEG1 to SEG3 and serve as switches connecting the drive lines SEG1 to SEG3 and GND, and are turned ON or OFF by the lighting controller 50. For the sink drivers SW21 to SW23, an NPN transistor or an N-channel field effect transistor (FET) can be used. The electric current flowing to the drive lines SEG1 to SEG3 can be controlled with a resistor and/or by a constant current source, or the like, which may be disposed between the sink drivers SW21 to SW23 and the GND, or between the sink drivers SW21 to SW23 and drive lines SEG1 to SEG3.

Lighting Controller 50

The lighting controller 50 controls ON or OFF of the source drivers SW11 to SW13 and the sink drivers SW21 to SW23, to control lighting of the plurality of light emitting elements LED1 to LED9. For example, when the LED 5 is lit, the SW12 and the SW22 are turned ON to apply voltage to allow an electric current flowing in a path: voltage V→common line COM2→LED5→drive line SEG2→GND, and the LED5 is turned on.

Frame

A frame is a unit of an image displayed on a screen of the display apparatus 100, and includes at least one sub-frame. A method of displaying a single frame in multi-gradation with a plurality of sub-frames can be referred to as a sub-frame modulation.

Sub-frame

A sub-frame is a unit of executing a scan through common lines, in which weighting control is applied to each of the common lines to express multiple gradations.

Display 10

Figure 4:
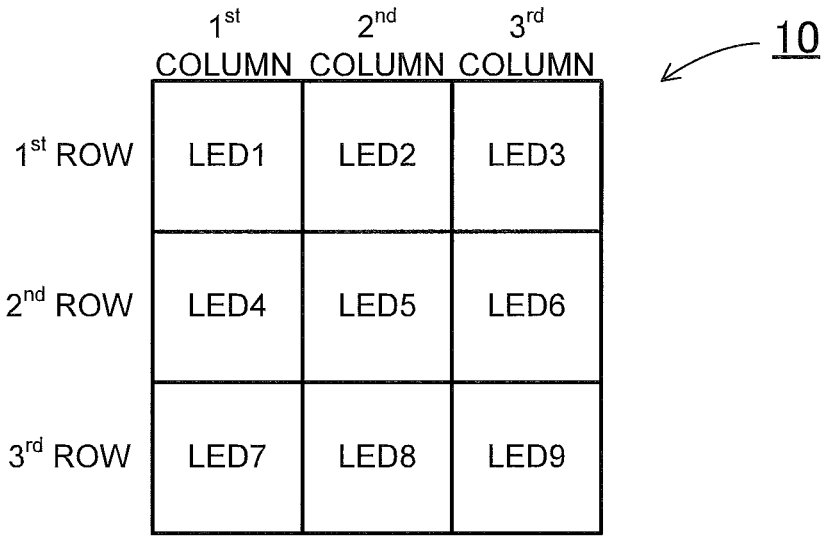
FIG. 4 is a diagram showing an example of a display of the display apparatus according to the first embodiment.

FIG. 4 shows an example of a display 10 of the display apparatus 100 according to the first embodiment of the present disclosure. As shown in FIG. 4, the display 10 has nine divisions that are arranged in a matrix of three rows and three columns. The plurality of light emitting elements LED1 to LED9 are assigned to the nine sections respectively. For example, during the lighting period of the light emitting element LED1, the section to which the light emitting element LED1 is assigned (e.g., the section at the first row and the first column) is turned on, and during the lighting period of the light emitting element LED9, the section to which the light emitting element LED9 is assigned (e.g., the section at the third row and the third column) is turned on.

Figure 5:
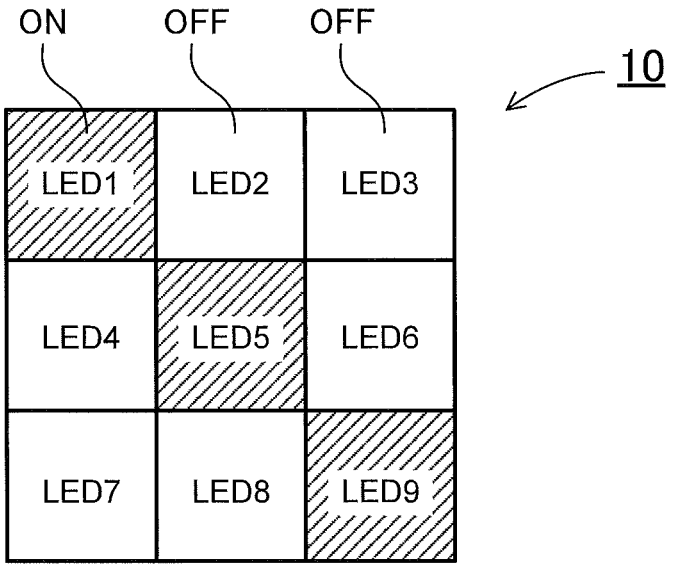
FIG. 5 is a diagram showing an example of a display executed in FIG. 4.

FIG. 5 is a diagram showing an example of a display executed in the display 10. As shown in FIG. 5, the display apparatus 100 according to the first embodiment displays a display shown in FIG. 5 on the display 10 shown in FIG. 4, by operating the plurality of light emitting elements LED1 to LED9 to turn ON or turn OFF. In FIG. 5, the sections that are turned ON are indicated with hatched lines.

Next, a reduction in pseudo lighting of a light emitting element will be illustrated with reference to FIG. 5, FIG. 6, and FIG. 7.

COMPARATIVE EXAMPLE

Figure 6:
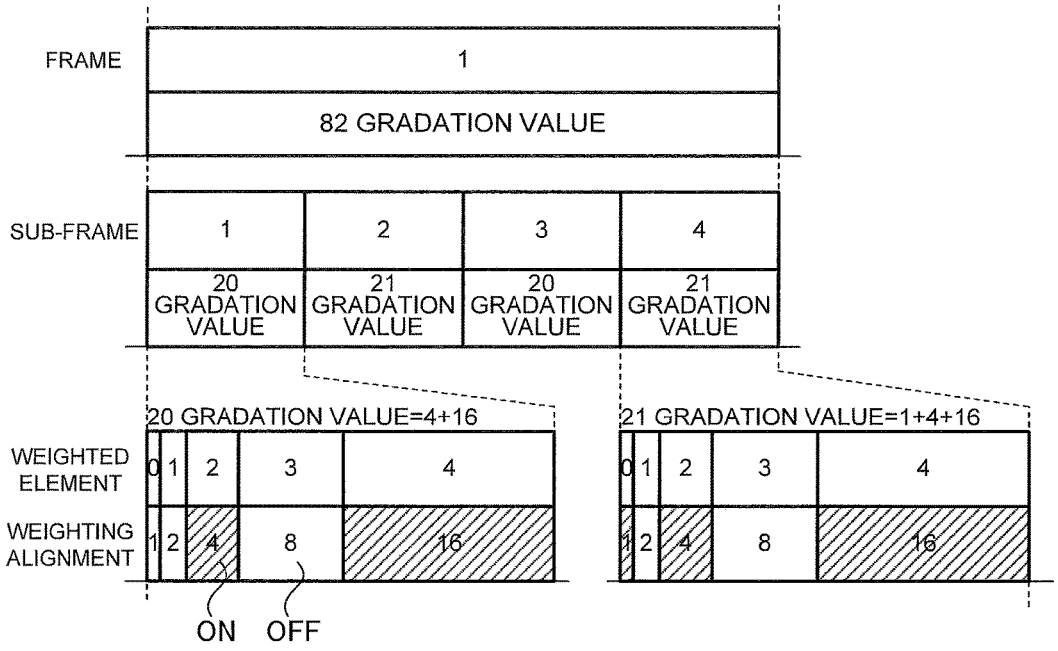
FIG. 6 is a timing chart showing a gradation control method according to Comparative Example.

FIG. 6 is a timing chart illustrating a gradation control method according to a Comparative Example. A single display, i.e., a single frame is divided into four sub-frames 1 to 4 in a time-sharing manner. Each sub-frame can express $2^5$=32 gradations so that with the four sub-frames, a single frame can be expressed with a maximum of 32 (gradation value)×4 (sub-frames)=128 gradation value. For example, when a single frame is expressed with 82 gradation value in a display apparatus that can express a single frame with a maximum of 128 gradations, the 82 gradation value is expressed by four sub-frames. In view of the easiness of design or the like, the gradations are allocated to the four sub-frames to obtain as uniform gradation value as possible among the sub-frames, in other words, the gradation value are allocated so that difference in gradation value among the sub-frames becomes small. Since 82 (gradation value)/4=20.5 (gradation value), in the example shown in FIG. 6, the gradations are divided into two 20 gradation value and two 21 gradation value. The value of gradation of 82 in decimal is 1010010 in binary, where the higher five bits (10100) represents the 20 (in decimal) gradations in a single sub-frame and the lower two bits (10) represents 2 (in decimal) that is the number of sub-frames involving the modulation. Thus, 20 gradation value and 21 gradation value are alternately allocated to the sub-frames 1 to 4, to 20 gradation value→21 gradation value→20 gradation value→21 gradation value. Next, allocation of the gradation value to each of the sub-frames (hereinafter may be referred to as "weighting arrangement") will be more specifically described. For each of the sub-frames 1 and 3, 20 gradation value is allocated. As described above, each sub-frame can express 5 bits, that is 32 gradation value. Elements (referred to as "weighted elements") are weighted by power of two and each weighted element is assigned to determine ON or OFF of corresponding one of the light emitting elements. The weighted elements expressed by power of two are arranged in ascending order. In the present Comparative Example, a five bit is employed, so that each sub-frame is designated with five weighted elements of $2^0$=1, $2^1$=2, $2^2$=4, $2^3$=8, and $2^4$=16. In the description below, the weighted elements will be named elements 0 to 4 corresponding to $2^0$ to $2^4$ to distinguish between weighted elements. Then, ON or OFF of corresponding light emitting elements are set to each of the weighted elements 0 to 4.

In the example shown in FIG. 6, the sub-frames 1, and 3 are assigned to 20 gradation value. Thus, as shown in the lower left of FIG. 4, only the weighted element 2 (4 gradation value) and the weighted element 4 (16 gradation value) are set to ON and the rest of the weighted elements 0, 1, and 3 are set to OFF. As described above, the duration of ON is indicated by hatched lines and the duration of OFF is indicated by blank space. Meanwhile, the sub-frames 2, and 4 are assigned to 21 gradation value, so that as shown in the lower right of FIG. 4, only the weighted element 0 (1 gradation value), the weighted element 2 (4 gradation value), and the weighted element 4 (16 gradation value) are set to ON and the rest of the weighted elements 1 and 3 are set to OFF. However, in such an allocation, the weighted element 4 (i.e., 16 gradation value) at the end of each sub-frame period is ON, which may cause a significant degree of pseudo lighting. As used in the present specification, the term "a significant degree of pseudo lighting" refers to an increase in the occurrence of pseudo lighting, more noticeable pseudo lighting, and/or an increase in brightness of pseudo lighting. Meanwhile, the term "decreasing the pseudo lighting" refers to a decrease in the occurrence of pseudo lighting, less noticeable pseudo lighting, and/or a decrease in brightness of pseudo lighting.

Occurrence of such a significant degree of pseudo lighting in performing a lighting control in a frame that includes such sub-frames will be described below more specifically with reference to an exemplary display shown in FIG. 5. When the light emitting elements LED1, LED5, and LED9 are turned ON in a single sub-frame, light emitting elements LED1, LED5, and LED9 are turned ON by the common lines COM1, COM2, and COM3, respectively. At this time, in the gradation lighting control method according to the Comparative Example, when the light emitting element LED1 is turned ON by using the common line COM1, the weighted element 4 (i.e., 16 gradation value) in ON, so that the parasitic capacitance between the drive line SEG 1 and GND cannot be charged (or charging-period is too short) through the light emitting element LED1. As a result, when light emitting element LED5 is turn on by the subsequent common line COM2, the parasitic capacitance between the drive line SEG1 and GND is charged through light emitting element LED4 that is not subjected to be turned ON, resulting in substantial degree of pseudo lighting at light emitting element LED 4. Also, the weighted element 4 (i.e., 16 gradation value) is ON when light emitting element LED5 is turned ON by using the common line COM2, so that the parasitic capacitance between the drive line SEG2 and GND is not charged (or charging-period is too short) through light emitting element LED5. As a result, when light emitting element LED9 is turn on by the subsequent common line COM3, the parasitic capacitance between the drive line SEG2 and GND is charged through light emitting element LED8 that is not subjected to be turned ON, resulting in substantial degree of pseudo lighting at light emitting element LED 8. Further, the weighted element 4 (i.e., 16 gradation value) is ON when light emitting element LED9 is turned ON by using the common line COM3, so that the parasitic capacitance between the drive line SEG3 and GND is not charged (or charging-period is too short) through light emitting element LED9. As a result, when light emitting element LED1 is turn on by the common line COM1 in another subsequent sub-frame, the parasitic capacitance between the drive line SEG3 and GND is charged through light emitting element LED3 that is not subjected to be turned ON, resulting in substantial degree of pseudo lighting at light emitting element LED3.

On the other hand, in the method of controlling gradation of the display device 100 according to the first embodiment, the order of the weighting elements is changed so that the weighting element at the end of each sub-frame is set to OFF. That is, the lighting controller sets the order of the weighting elements in at least one of a plurality of sub-frames of a single frame to be different from the order of the weighting elements in at least one of a plurality of sub-frames of another frame. In addition, among a plurality of weighted elements in at least one of a plurality of sub-frames in a single frame, the weighting element at the end of the timeline turns OFF its corresponding the light emitting element. Thus, the weighted elements provided with gradation values of power of two in at least one sub-frame in a frame are not set in a regular order such as ascending order or descending order, and the order in the frame is set to be different from that in another frame such that the weighting element at the end of turns OFF its corresponding light emitting element. This configuration allows for reducing pseudo lighting due to charging/discharging parasitic capacitance.

Instead of setting different order of the weighting elements among the frames, order of weighting elements may be different among the sub-frames in a single frame. That is, the order of the weighted elements in at least one of a plurality of sub-frames in a single frame may be set to be different from the order of the weighted elements in at least one other sub-frame in the single frame.

Further, when the maximum gradation value that can be expressed by a sub-frame is $2^Y-1$ (Y is an integer greater than 1), the light emitting element corresponding to the weighted element having gradation $2^{Y-2}$ at the end of the timeline in a single sub-frame can be turned OFF. This configuration can extend the period in which the light emitting element is turned OFF, so that the pseudo lighting reducing effect is expected to be enhanced.

As described above, providing a period to turn OFF the light emitting element at the end of each sub-frame may allow charging of pseudo lighting element between the drive line and GND reduce the pseudo lighting in the period, and thus a reduction in the pseudo lighting can be expected. It is preferable that the light emitting element corresponding to the weighted element at the end of weighting alignment is OFF in at least a half number of sub-frames in a single frame. Further, it is preferable that, the light emitting element corresponding to the weighting element at the end of the timeline in the weighting alignment in each sub-frame in a single frame, is turned OFF. Even further, the longer the period of turning OFF the light emitting element is OFF corresponding to the weighted element at the end of the timeline in a sub-frame, the greater the pseudo lighting reducing effect is exhibited, and thus the more preferable.

Figure 7:
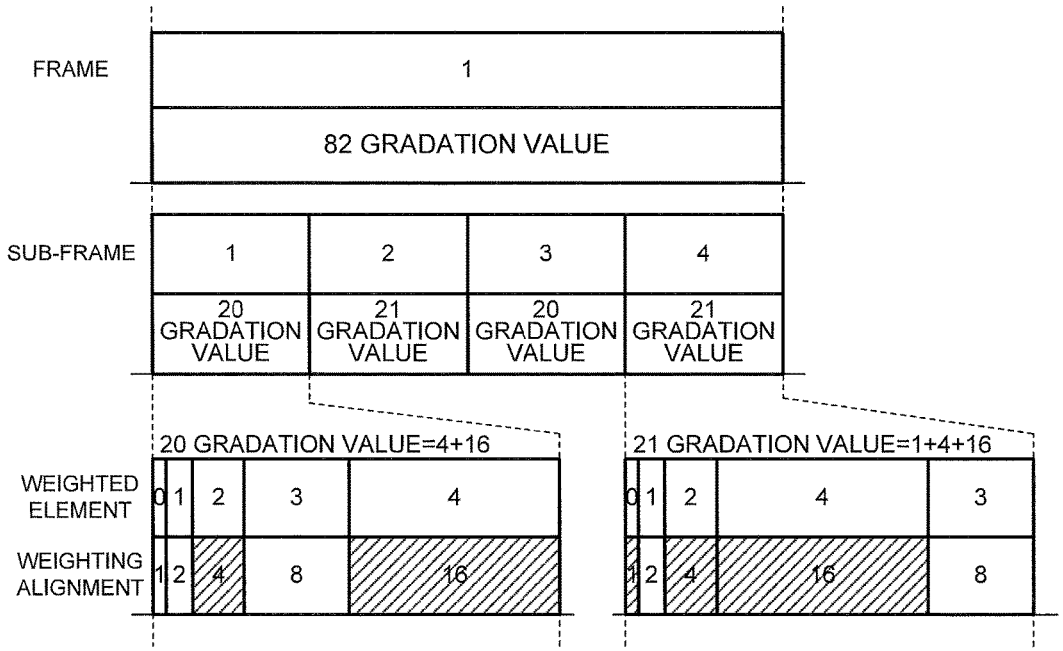
FIG. 7 is a timing chart showing a gradation control method according to the first embodiment.

With reference to FIGS. 6, 7, etc., the above-described method as the gradation control method according to the first embodiment will be described below.

As in the timing chart of FIG. 6 of the gradation controlling method according to Comparative Example, in the timing chart of FIG. 7 of the gradation controlling method according to the first embodiment, a single display, that is, a single frame is divided into four sub-frames 1 to 4, i.e., Y=4, in a time-sharing manner. Each of the sub-frames can express X=5 bits, that is, $2^5=32$ gradations. Herein, in a single frame, 32 gradations×4 sub-frames=a maximum of 128 gradations can be expressed with the four sub-frames. For example, when a single frame is expressed with 82 gradation value in a display apparatus that can express a single frame with a maximum of 128 gradations with one frame, the 82 gradation value is expressed by four sub-frames. In FIG. 7, in view of preventing flicker and the like, the gradations are allocated to the four sub-frames so as to obtain as uniform gradation value as much as possible among the sub-frames, in other words, the gradation values are allocated so that difference in gradation value among the sub-frames becomes small. Since 82 (gradation value) ÷4=20.5 (gradation value) in the example shown in FIG. 7, the gradations are divided into two 20 gradation value and two 21 gradation value. Then, in order to prevent flicker, 20 gradation value and 21 gradation value are alternatively allocated to the sub-frames 1 to 4 as follows: 20 gradation value→gradation value→20 gradation value→21 gradation value. Next, allocation of gradation values to each of the sub-frames in this case will be more specifically described. For each of the sub-frames 1 and 3, 20 gradation is allocated. As described above, each of the sub-frames can express 5 bits, that is, 32 gradation value. Elements are weighted by power of two, and each weighted element is assigned to determine ON/OFF of a corresponding one of the light emitting elements.

While the weighted elements expressed by a power of two are arranged in ascending order in Comparative Example shown in FIG. 6, the order of the weighted elements is not limited to a regular order such as ascending order or descending order in the first embodiment. That is, in at least one of the sub-frames in one frame, the order of weighted elements is set to be changed. More specifically, at least one of the weighted elements corresponding to the light emitting element set to be turned OFF is shifted to the end of the weighting alignment. Such a change in the order of the weighted elements is made by the lighting controller 50. In the example shown in FIG. 7, the weighted elements are aligned in ascending order in the sub-frames 1 and 3 as in Comparative Example shown in FIG. 6. On the other hand, in the sub-frames 2 and 4, of the weighted elements corresponding the light emitting element set to be turned OFF, the weighted element 3 with the greatest gradation value 8 is shifted to the end of the weighting alignment. With such a change, pseudo lighting due to charging/discharging parasitic capacitance can be reduced. In particular, this configuration allows for extending the period in which the light emitting element is turned OFF, so that improvement in the pseudo lighting reducing effect can be expected.

Figure 8:
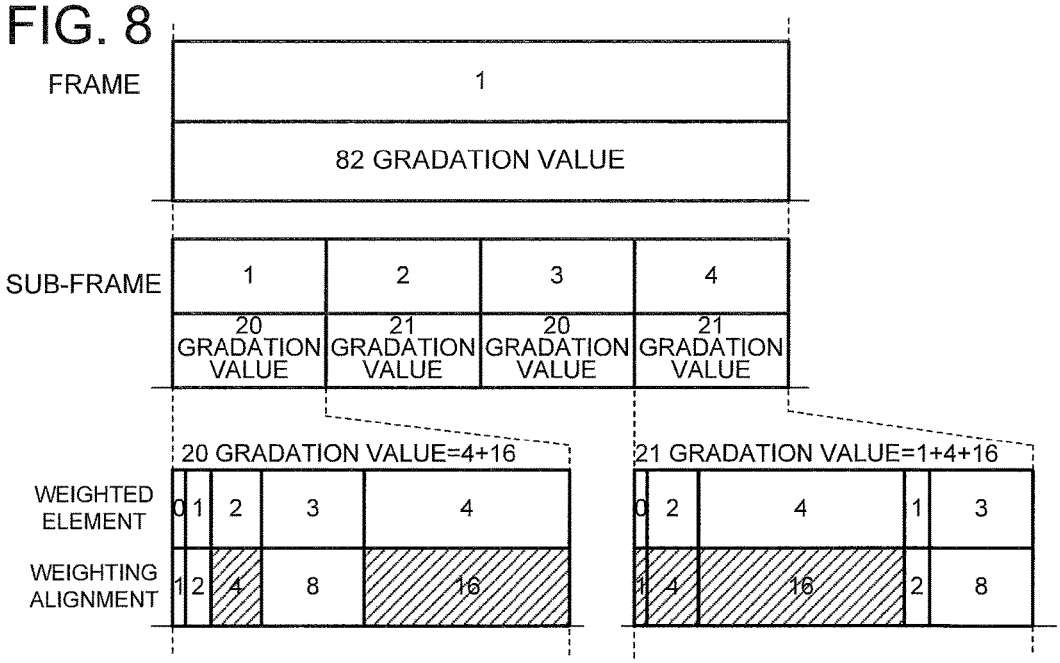
FIG. 8 is a timing chart showing a gradation control method according to a second embodiment.

In the example described above, of the weighted elements set to turn OFF its corresponding light emitting elements, just the weighted element having the greatest gradation value is shifted to the end of the weighting alignment. Alternatively, a plurality of weighted elements set to turn OFF its corresponding light emitting element may be shifted to the end of the weighting alignment. For example, in a gradation controlling method according to the second embodiment shown in FIG. 8, the weighted element 1 having gradation 2 and set to turn OFF its corresponding light emitting element is also shifted to the end of the weighting alignment. In this case, the weighted elements set to turn OFF may be aligned in any order. For example, they may be in ascending order as in the second embodiment shown in FIG. 8, that is, in order of the weighted elements 1 and 3.

Figure 9:
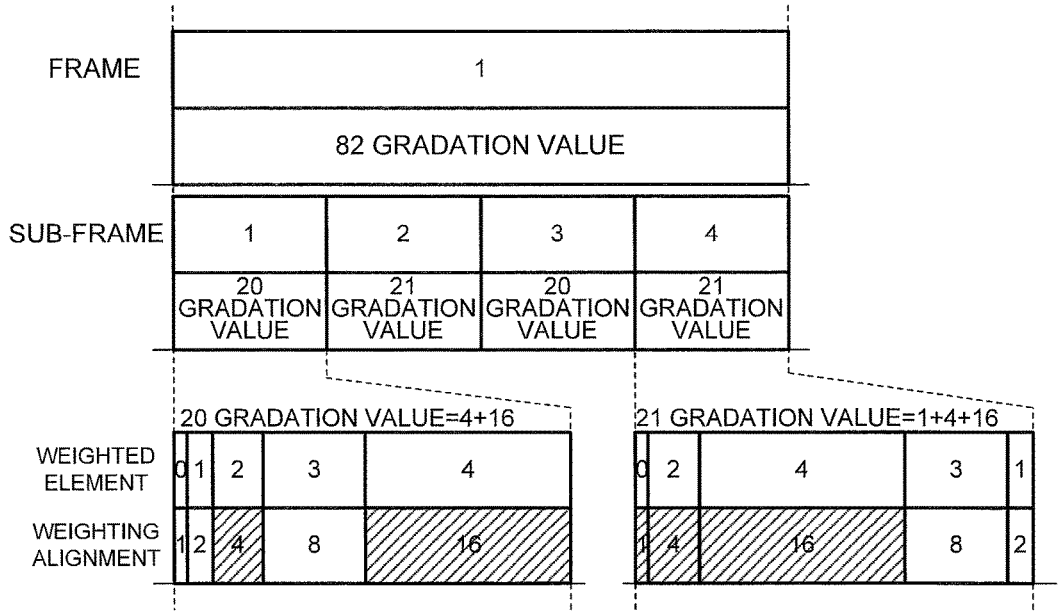
FIG. 9 is a timing chart showing a gradation control method according to a third embodiment.

Alternatively, they may be in descending order as in a timing chart of a gradation controlling method shown in FIG. 9 as a third embodiment, that is, in order of the weighted elements 3 and 1. Further alternatively, when three or more weighted elements set to turn OFF their corresponding light emitting elements are shifted to the end of the weighting alignment, the shifted three or more weighted elements may be arranged at random.

Further, the order of the weighted elements is varied in a half of the sub-frames in a single frame in the example above, but the order of weighted elements set to turn OFF their corresponding light emitting elements may be varied in sub-frames greater than a half of the sub-frames in one frame. The greater the number of such sub-frames, the more pseudo lighting reducing effect can be enhanced. The number of sub-frames in which the order of the weighted elements is varied may be selected in accordance with the required display quality or the like of the display apparatus.

FOURTH EMBODIMENT

Figure 10:
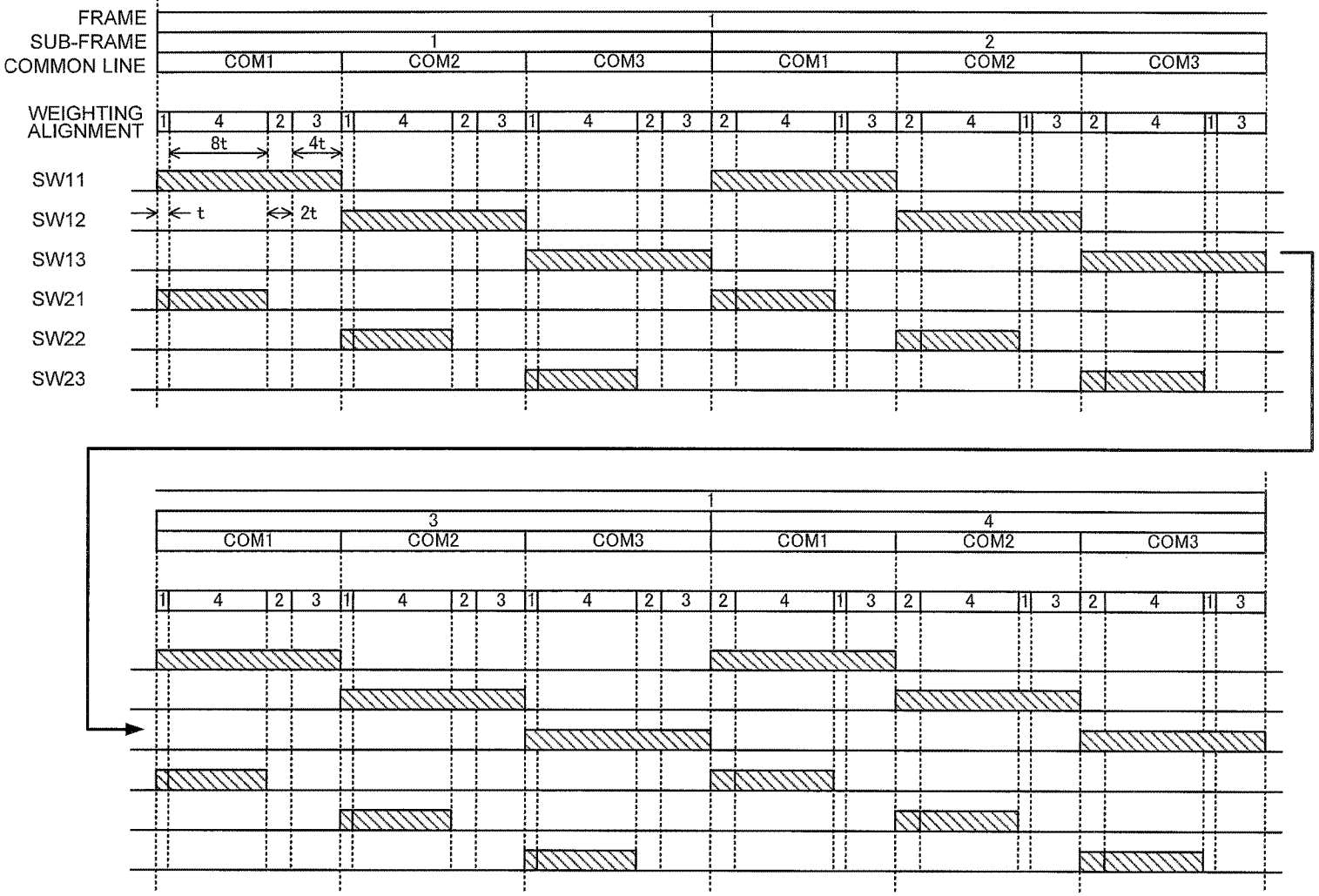
FIG. 10 is a timing chart showing a gradation control method according to a fourth embodiment.

FIG. 10 shows a timing chart of a display apparatus according to a fourth embodiment. The display apparatus according to the fourth embodiment is different from a display apparatus according to a fifth embodiment, which will be described below, in that the order of the weighting elements is different among sub-frames in accordance with gradations.

In the present embodiment, each frame includes four sub-frames. Each of the sub-frames are controlled by four levels of weighting by powers of 2 (1:2:4:8), so that 64 levels (i.e., $2^4 \times 4$ (number of sub-frames)=64) can be displayed in a single frame.

Each sub-frame scans three common lines, and is subject to weighted control based on one unit, which is designated to scanning of a single common line. As in the fifth embodiment, the period of a weighted element 1 is indicated as t, the period of a weighted element 2 is indicated as 2t, and the period of a weighted element 3 is indicated as 4t, and the period of a weighted element 4 is indicated as 8t.

For the sake of brevity, the description will be given based on that all of the hatched portions in FIG. 5 are indicated as gradation value 38, and all of blank portions in FIG. 5 are indicated as gradation value 0. That is, lighting control is exerted based on that blank portions are indicated as gradation value 9, and hatched portions are indicated as gradation value 0 in the sub-frame 1; blank portions are indicated as gradation value 10 and hatched portions are indicated as gradation value 0 in the sub-frame 2; blank portions are indicated as gradation value 9 and hatched portions are indicated as gradation value 0 in the sub-frame 3; and blank portions are indicated as gradation value 10 and hatched portions are indicated as gradation value 0 in the sub-frame 4.

In the sub-frame 1, during the scanning period of COM1, SW11 is ON and SW12 and SW13 are OFF. During the scanning period of COM1, SW21 is turned ON at the weighted element 1 and 4, turned OFF at the weighted elements 2 and 3, and SW22 and SW23 are turned OFF at all the weighted elements 1 to 4, thus LED1 is turned ON with 9 gradations, and LED2 and LED3 are turned OFF with 0 gradation value. Thus, the weighted elements are arranged in order of the weighted element 1→the weighted element 4→the weighted element 2→the weighted element 3.

Similarly, during the scanning period of COM2, SW12 is ON and SW11 and SW13 are OFF. During the scanning period of COM2, SW22 is turned ON at the weighted elements 1 and 4, turned OFF at the weighted elements 2 and 3, and SW21 and SW23 are turned OFF at all the weighted elements 1 to 4, thus LED5 is turned ON with 9 gradation value and LED4 and LED6 are turned OFF with 0 gradation value. Thus, the weighted elements are arranged in order of the weighted element 1→the weighted element 4→the weighted element 2→the weighted element 3.

Similarly, during the scanning period of COM3, SW13 is ON and SW11 and SW12 are OFF. During the scanning period of COM3, SW23 is turned ON at the weighted elements 1 and 4, turned OFF at the weighted elements 2 and 3, and SW21 and SW22 are turned OFF at all the weighted elements 1 to 4, thus LED9 is turned ON with 9 gradation value and LED7 and LED8 are turned OFF with 0 gradation value. Thus, the weighted elements are arranged in order of the weighted element 1→the weighted element 4→the weighted element 2→the weighted element 3.

In the sub-frame 2, during the scanning period of COM1, SW11 is ON and SW12 and SW13 are OFF. During the scanning period of COM1, SW21 is turned ON at the weighted elements 2 and 4, turned OFF at the weighted elements 1 and 3, and SW22 and SW23 are turned OFF at all the weighted elements 1 to 4, thus LED1 is turned ON with 10 gradation value and LED2 and LED3 are turned OFF with 0 gradation value. Thus, the weighted elements are arranged in order of the weighted element 2→the weighted element 4→the weighted element 1→the weighted element 3.

Similarly, during the scanning period of COM2, SW12 is ON and SW11 and SW13 are OFF. During the scanning period of COM2, SW22 is turned ON at the weighted elements 2 and 4, turned OFF at the weighted elements 1 and 3, and SW21 and SW23 are turned OFF at all the weighted elements 1 to 4, thus LED5 is turned ON with 10 gradation value and LED4 and LED6 are turned OFF with 0 gradation value. Thus, the weighted elements are arranged in order of the weighted element 2→the weighted element 4→the weighted element 1→the weighted element 3.

Similarly, during the scanning period of COM3, SW13 is ON and SW11 and SW12 are OFF. During the scanning period of COM3, SW23 is turned ON at the weighted elements 2 and 4, turned OFF at the weighted elements 1 and 3, and SW21 and SW22 are turned OFF at all the weighted elements 1 to 4, thus LED9 is turned ON with 10 gradation value and LED7 and LED8 are turned OFF with 0 gradation value. Thus, the weighted elements are arranged in order of the weighted element 2→the weighted element 4→the weighted element 1→the weighted element 3.

The lighting control of the sub-frame 3 is similar to that of the sub-frame 1 and the sub-frame 4 is similar to that of the sub-frame 2, so that repetitive description will be appropriately omitted.

As described above, with the display apparatus according to the fourth embodiment, by changing the order in the weighted alignment among sub-frames in accordance with gradations, the number of lighting at the end of the weighting alignment can be reduced. Thus, pseudo lighting can be reduced. Meanwhile, the order in the weighting alignment may be different among frames. For example, while the order in the weighted alignment may be different among the sub-frames in a single frame, the order in the weighted alignment may be the same among the frames. Such an example will be described below as a display device according to the fifth embodiment with reference to a timing chart of FIG. 11.

FIFTH EMBODIMENT

Figure 11:
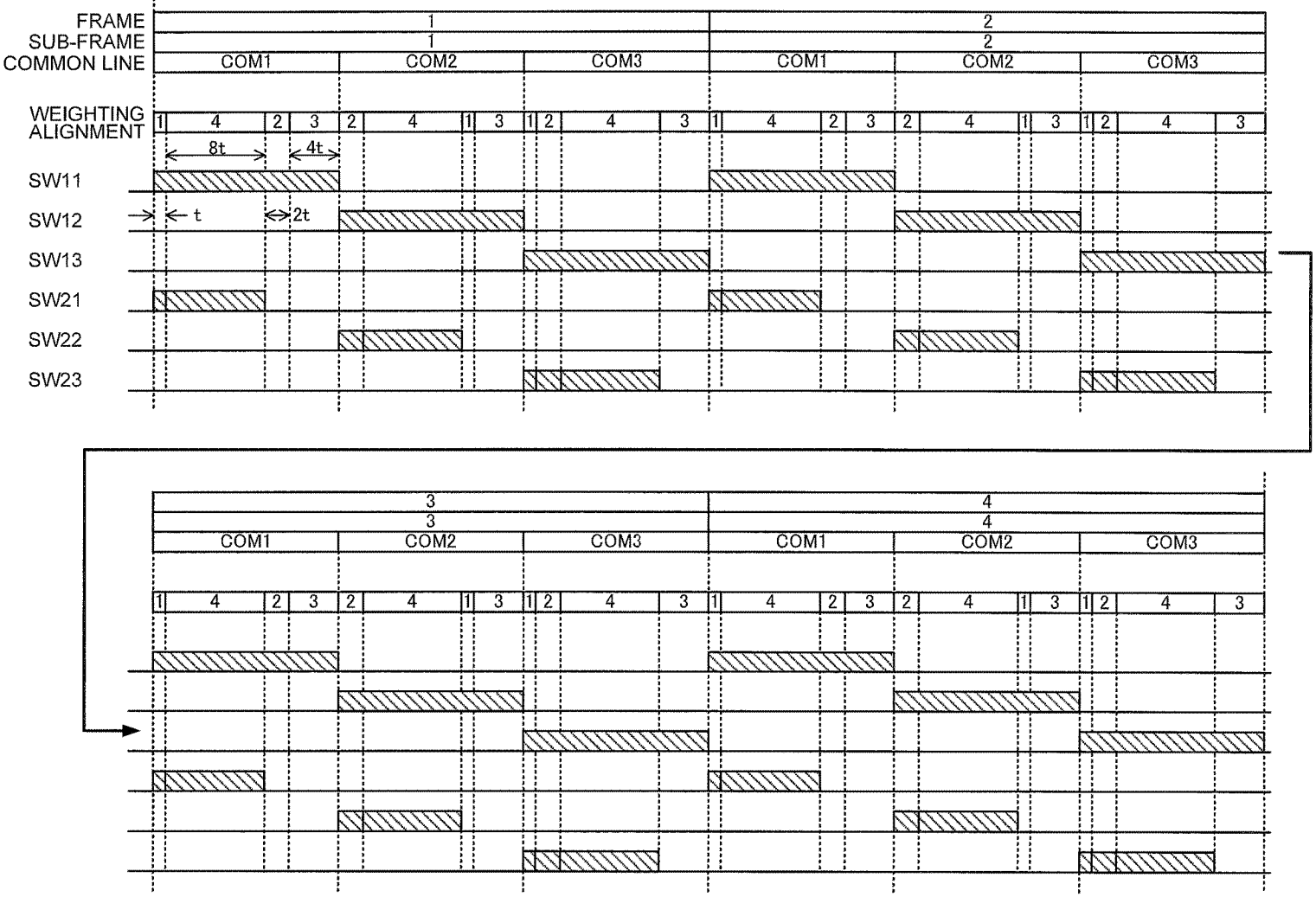
FIG. 11 is a timing chart showing a gradation control method according to a fifth embodiment.

With the display device according to the fifth embodiment, as shown in the timing chart of FIG. 11, a single frame has four sub-frames. Each of the sub-frames is controlled by four levels of weighting by powers of 2 (1:2:4:8), so that 16 levels (i.e., $2^4=16$) of gradations can be displayed in a single sub-frame. In the present embodiment, the description will be given based on that the display of FIG. 5 is repeated for 4 frames, and in each of which frames 1 to 4, blank portions are indicated as gradation values 9, 10, 11, in order from the upper left to the lower right, and hatched portions are all indicated as gradation value 0. In this manner, when the same display is repeated for a plurality of frames, a still image is provided.

With reference to a timing chart of FIG. 11, the manner of exerting gradation control will be described below. In the present embodiment, each four frames has one sub-frame that scans three common lines. One unit, which is designated to scanning of a single common line, is controlled by four levels of weighting.

Five level weightings are indicated by weighted elements 1 to 4, in which the period of the weighted element 1 is indicated as t, the period of the weighted element 2 is indicated as 2t, the period of the weighted element 3 is indicated as 4t, and the period of the weighted element 4 is indicated as 8t. The light emitting elements to be lit with gradation value 9 are turned on at the weighted elements 1 and 4, and are turned off at the weighted elements 2 and 3. The light emitting elements to be lit with gradation value 10 are turned on at the weighted elements 2 and 4, and are turned off at the weighted elements 1 and 3. The light emitting elements to be lit with gradation value 11 are turned on at the weighted elements 1, 2, and 4, and are turned off at the weighted element 3. The light emitting elements to be lit with gradation value 0 are all turned off at the weighted elements 1 to 4.

In the frame 1 (i.e., the sub-frame 1), the SW11 is turned ON and the SW12 and the SW13 are turned OFF during the scanning period of the COM1. During the scanning period of the COM1, the SW21 is turned ON at the weighted elements 1 and 4, and turned OFF at the weighted elements 2 and 3; and the SW22 and the SW23 are turned OFF with all the weighted elements 1 to 4, so that the LED1 is turned on with by the gradation value 9, and the LED2 and the LED3 are turned OFF with the gradation value 0. Thus, the weighted elements are arranged in order of the weighted element 1→the weighted element 4→the weighted element 2→the weighted element 3.

Similarly, in the scanning period of the COM2, the SW12 is ON and the SW11 and the SW13 are OFF. In the scanning period of the COM2, the SW22 is turned ON at the weighted elements 2 and 4, and is turned OFF at the weighted elements 1 and 3; and the SW21 and the SW23 are turned OFF at all the weighted elements 1 to 4, the LED5 is lit up with the gradation value 10, and the LED4 and the LED6 are with the gradation value 0. Thus, the weighted elements are arranged in order of the weighted element 2→the weighted element 4→the weighted element 1→the weighted element 3.

Similarly, in the scanning period of the COM3, the SW13 is turned ON, and the SW11 and the SW12 are turned OFF. In the scanning period of the COM3, the SW23 is turned ON at the weighted element 1, the weighted element 2, and the weighted element 4, and turned OFF at the weighted element 3; the SW21 and the SW22 are turned OFF at all the weighted elements 1 to 4, the LED9 is turned on with the gradation value 11, and the LED7 and the LED8 are turned off with the gradation value 0. Thus, the weighted elements are arranged in order of the weighted element 2→the weighted element 4→the weighted element 1→the weighted element 3.

The lighting control in the frames 2 to 4 is similar to that in the frame 1 and, therefore, the description thereof will be omitted.

As has been described above, with the display device according to the fifth embodiment, the order in the weighted alignment can be different among units, each of which is designated to scanning of a single common line, in accordance with gradation value, so that the number of lighting at the ends in timelines of the weighted alignment. Thus, pseudo lighting can be reduced.

Further, while the description in the first, second, and third embodiments has been given based on that of the display device, the first to third embodiments are applicable to a gradation controlling method of the display device.

SIXTH EMBODIMENT

Figure 12:
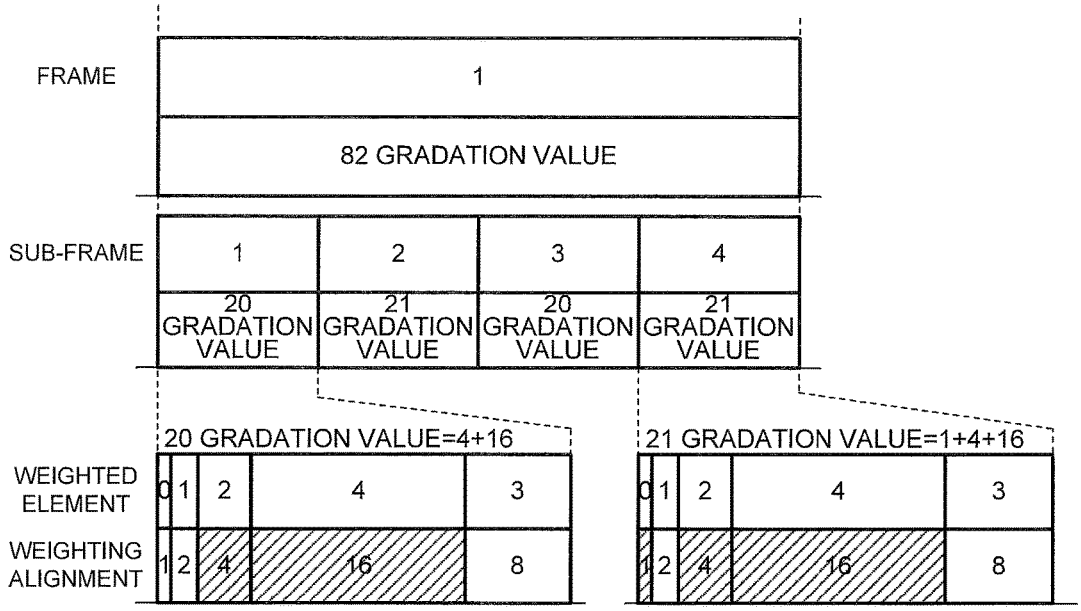
FIG. 12 is a timing chart showing a gradation control method according to a sixth embodiment.

In the embodiments described above, the description has been given of the examples where lighting control is exerted so that, in one frame, the light emitting element corresponding to the weighted element at the end of the timeline is turned OFF in any of the sub-frames. The lighting control may be exerted so that the weighted element at the end of the timeline in each sub-frame of a single frame. Such an example is shown in a timing chart of FIG. 12 as a sixth embodiment. In this example, similarly to the above-described first embodiment or the like, of four sub-frames, 20 gradation value is allocated to the sub-frames 1 and 3, and 21 gradation value is allocated to the sub-frames 2 and 4, so that 82 gradation value is expressed as a whole. Similarly to FIG. 7, in the sub-frames 2 and 4, the weighting elements are in order of 0, 1, 2, 4, 3. Among these, the light emitting element is turned OFF at the weighted elements 1 and 3, and is turned ON at the weighted elements 0, 2, and 4. Thus, 1+4+16=21 gradations in total is expressed. On the other hand, also in the sub-frames 1 and 3, the weighted elements are in order of 0, 1, 2, 4, 3. Among these, the light emitting element is turned OFF at the weighted elements 0, 1, 3, and is turned ON at the weighted elements 2 and 4. Thus, 4+16=20 gradations in total is expressed. In this manner, the order of the weighted elements is changed in each of the sub-frames, the period where the light emitting element is turned OFF at the end of the timeline of each of the sub-frames can be cumulatively extended, so that the pseudo lighting reducing effect can be improved.

EXAMPLE 1

Next, a display apparatus according to Example 1 will be described below.

In the display apparatus according to Example 1, 1728 LEDs (including three colors of light emitting elements; Red, Green, and Blue) were arranged in rows and columns at intervals of 4 mm. Further, 24 common lines connected to anodes of the LEDs were disposed in the lateral direction, while 216 lines (72 lines×3 colors) of drive lines connected to cathodes of the LEDs were disposed in the longitudinal direction.

A DC 5V constant voltage source was employed as the power supply. A FPGA was employed as the lighting controller 50 that time-divisionally applies voltage to the common lines. A P-channel FET was employed as the source driver, and an NPN transistor driven by a constant-current set to about 18 mA was employed as the sink driver. For the lighting controller 50 that turns ON and OFF the switches and changes sequence in the weighting alignments, a field programmable gate array (FPGA), a microcomputer, or a combination of those can be employed.

The display apparatus according to Example 1 was dynamically driven at a duty ratio of 1/24. The period of applying voltage to a single common line was 47.9 μs, and the period when no voltage is applied to any common lines was 10 μs. At this time, the sub-frame cycle is (47.9 μs+10 μs)×24 rows=1.39 ms.

Thus, 32 sub-frames were set at a cycle of 16.7 ms (60 Hz) that is common for video signals. A single sub-frame was subjected to a six-levels weighted control by powers of 2. At t=729.2 ns, durations in the weighted alignments are set as follows: the element 1=t, the element 2=2t, the element 3=4t, the element 4=8t, the element 5=16t, the element 6=32t. With 32 sub-frames and the six-level weighted control, 2048 gradations in total ($2^6$×32 (sub-frame)=2048) can be expressed.

In order to facilitate study of the effect, 1728 LEDs are arranged in a matrix of 24 rows and 72 columns, and each unit of 24-row×24-column are turned on from the upper left to the lower right to exhibit a diagonal lighting. The diagonal line is expressed by 1024 gradations, and the background, which was expressed by the other LEDs, is turned off at gradation value 0.

The lighting was expressed by the sub-frame modulation, in which each of the sub-frames 1 to 32 was set with the diagonal line of gradation value 32, and the background is set to gradation value 0. In each sub-frame, the lighting control is exerted such that only the element 6 is set to ON, and the order in the weighted alignment in the sub-frame is as follows: the weighted element 1→the weighted element 2→the weighted element 3→the weighted element 4→the weighted element 6→the weighted element 5. That is, the lighting control is exerted to be turned OFF at the weighted element 5 at the end of the timeline in the weighted alignment.

Visual inspection in a darkroom indicated that pseudo lighting was reduced in the display apparatus described above than that in Comparative Example 1 which will be described below. Accordingly, the display apparatus according to Example 1 can be evaluated as a display apparatus with high display quality.

COMPARATIVE EXAMPLE 1

Next, a display apparatus according to Comparative Example 1 will be discussed. The display apparatus according to Comparative Example 1 has basically the same configuration as the display apparatus according to Example 1, but in a sub-frame modulation, each of the sub-frames 1 to 32 was set with the diagonal line of 32 gradations, the background of gradation value 0, and the order in the weighted alignment is as follows: the weighted element 1→the weighted element 2→the weighted element 3→the weighted element 4→the weighted element 5→the weighted element 6. Similarly to Example 1, the lighting control was exerted in which only the weighted element 6 is set to ON.

Visual inspection in a darkroom indicated that pseudo lighting was more significant than in Example 1. Accordingly, the display apparatus according to Comparative Example 1 can be evaluated as a display apparatus with poor display quality.

Certain embodiments and Examples have been described above, but the scope of the present invention is not limited to the above description, and should be widely understood based on the scope of claims for patent.

The display device according to the present invention can be utilized, for example, a large-screen TV, a message board displaying information such as traffic information, or the like.

What is claimed is:

1. A display device comprising: a plurality of common lines;

a plurality of drive lines;

a plurality of light emitting elements respectively connected to one common line of the plurality of common lines and to one drive line of the plurality of drive lines;

a voltage scanner to time-divisionally apply a voltage on the plurality of common lines; a current driver to draw electric current at a predetermined timing from drive lines, of the plurality of drive lines, electrically connected to respective light emitting elements, of the plurality of light emitting elements, to turn ON the respective light emitting elements; and a lighting controller to vary lighting periods of the plurality of light emitting elements to express lighting amounts as different gradation values, wherein an image provided by the voltage scanner on the display device is expressed in a plurality of single frames including a one frame and another frame;

wherein the one and another frame of the plurality of single frames is divided into a plurality of sub-frames and a gradation value to express each of the one and another frame is divided into gradation values and allocated to the plurality of sub-frames, the gradation values allocated to the sub-frames are time-divisionally expressed so that the gradation value of the one and another frame is expressed by a total of the gradation values of the sub-frames, wherein each of the plurality of sub-frames includes a plurality of weighted elements with different gradation values to express the gradation values by powers of two, and wherein the lighting controller performs control such that the weighted elements in at least one sub-frame of the plurality of sub-frames in the one frame are aligned in an order different from an order of the weighted elements in at least one sub-frame of the plurality of sub-frames in another frame and, of the plurality of weighted elements in at least one sub-frame of the plurality of sub-frames in the one or another frame of the single frame, the weighted elements are rearranged so that the weighted element at the end of the sub-frame turns OFF a corresponding one light emitting element of the plurality of light emitting elements.

2. The display device according to claim 1, wherein the weighted elements in the at least one sub-frame of the plurality of sub-frames in said one frame are aligned in an order different from an order of the weighting elements in at least another one sub-frame of the plurality of sub-frames in said one frame.

3. The display device according to claim 1, wherein, when a maximum gradation value that can be expressed by each of the sub-frames is 2.sup.Y−1, where Y is an integer greater than 1, in a single sub-frame, a weighted element having gradation of 2.sup.Y−2 at the end of the sub-frame turns OFF a corresponding one light emitting element of the plurality of light emitting elements.

4. The display device according to claim 2, wherein, when a maximum gradation value that can be expressed by each of the sub-frames is 2.sup.Y−1, where Y is an integer greater than 1, in a single sub-frame, a weighted element having gradation of 2.sup.Y−2 at the end of the sub-frame turns OFF a corresponding one light emitting element of the plurality of light emitting elements.

5. The display device according to claim 1, wherein, in a single sub-frame, the light emitting elements corresponding to a plurality of weighting elements subsequently arranged at the end of the timeline are turned OFF.

6. The display device according to claim 2, wherein, in a single sub-frame, the light emitting elements corresponding to a plurality of weighting elements subsequently arranged at the end of the sub-frame are turned OFF.

7. The display device according to claim 3, wherein, in the single sub-frame, the light emitting elements corresponding to a plurality of weighting elements subsequently arranged at the end of the sub-frame are turned OFF.

8. The display device according to claim 1, wherein, among a plurality of sub-frames in the single frame, a light emitting element corresponding to the weighted element at the end of the sub-frame of a single sub-frame is turned OFF at a half or greater number of sub-frames in the single frame.

9. The display device according to claim 2, wherein, among a plurality of sub-frames in the single frame, a light emitting element corresponding to the weighted element at the end of the sub-frame of a single sub-frame is turned OFF at a half or greater number of sub-frames in the single frame.

10. The display device according to claim 3, wherein, among a plurality of sub-frames in the single frame, a light emitting element corresponding to the weighted element at the end of the sub-frame of the single sub-frame is turned OFF at a half or greater number of sub-frames in the single frame.

11. The display device according to claim 5, wherein, among a plurality of sub-frames in the single frame, a light emitting element corresponding to the weighted element at the end of the sub-frame of the single sub-frame is turned OFF at a half or greater number of sub-frames in the single frame.

12. The display device according to claim 6, wherein, among a plurality of sub-frames in the single frame, a light emitting element corresponding to the weighted element at the end of the sub-frame of the single sub-frame is turned OFF at a half or greater number of sub-frames in the single frame.

13. A display device comprising:

a plurality of common lines;

a plurality of drive lines;

a plurality of light emitting elements respectively connected to one common line of the plurality of common lines and to one drive line of the plurality of drive lines;

a voltage scanner to time-divisionally apply a voltage on the plurality of common lines; a current driver to draw electric current at a predetermined timing from drive lines, of the plurality of drive lines, electrically connected to respective light emitting elements, of the plurality of light emitting elements, to turn ON the respective light emitting elements; and a lighting controller to vary lighting periods of the plurality of light emitting elements to express lighting amounts as different gradation values, wherein an image provided by the voltage scanner on the display device is expressed in a plurality of single frames;

wherein a single frame of the plurality of single frames is divided into a plurality of sub-frames and a gradation value to express in the single frame is divided into gradation values and allocated to the plurality of sub-frames, the gradation values allocated to the sub-frames are time-divisionally expressed so that the gradation value of the single frame is expressed by a total of the gradation values of the sub-frames, wherein each of the plurality of sub-frames includes a plurality of weighted elements with different gradation values to express the gradation values by powers of two, and wherein the lighting controller performs control such that the weighted elements in at least one sub-frame of the plurality of sub-frames in the single frame are rearranged in an order different from an order of the weighted elements in at least another sub-frame of the plurality of sub-frames in the single frame and, the plurality of weighted elements in the at least one sub-frame of the plurality of sub-frames in the single frame are arranged so that the weighted element at the end of the sub-frame turns OFF a corresponding one light emitting element of the plurality of light emitting elements.

14. The display device according to claim 13, wherein, when a maximum gradation value that can be expressed by each of the sub-frames is 2.sup.Y−1, where Y is an integer greater than 1, in a single sub-frame, a weighted element having gradation of 2.sup.Y−2 at the end of the sub-frame turns OFF the corresponding one light emitting element of the plurality of light emitting elements.

15. The display device according to claim 13, wherein, in a single sub-frame, the light emitting elements corresponding to a plurality of weighting elements subsequently arranged at the end of the sub-frame are turned OFF.

16. The display device according to claim 13, wherein, among a plurality of sub-frames in the single frame, a light emitting element corresponding to the weighted element at the end of the sub-frame of a single sub-frame is turned OFF at a half or greater number of sub-frames in the single frame.

* * * * *